United States Patent [19]

Färber et al.

[11] Patent Number: 5,054,684

[45] Date of Patent: Oct. 8, 1991

[54] PACKAGE FOR LIQUID

[75] Inventors: Jürgen Färber, Kaarst; Matthias Dammers, Alsdorf, both of Fed. Rep. of Germany

[73] Assignee: PKL Verpackungssysteme GmbH, Dusseldorf, Fed. Rep. of Germany

[21] Appl. No.: 515,863

[22] Filed: Apr. 27, 1990

[30] Foreign Application Priority Data

May 2, 1989 [DE] Fed. Rep. of Germany ..... 3914497

[51] Int. Cl.[5] ..... B65D 5/42

[52] U.S. Cl. ..... 229/103.1; 215/1 A

[58] Field of Search ..... 229/103.1, 906.1, 907, 229/904; 215/1 A; 220/90.2

[56] References Cited

U.S. PATENT DOCUMENTS

| | | | |
|---|---|---|---|
| 3,494,536 | 2/1970 | Henry | 229/907 |
| 3,596,829 | 8/1971 | Gardner . | |
| 3,822,030 | 7/1974 | Tanzer | 229/103.1 |
| 4,036,392 | 7/1977 | Martin | 229/103.1 |
| 4,244,474 | 1/1981 | Wise | 229/103.1 |
| 4,438,865 | 3/1984 | Scattaregia | 229/103.1 |
| 4,511,042 | 4/1985 | Wischusen, III | 229/904 |
| 4,534,489 | 8/1985 | Bartlett | 229/907 |
| 4,591,091 | 5/1986 | Wise | 229/103.1 |
| 4,762,514 | 8/1988 | Yoshida . | |

FOREIGN PATENT DOCUMENTS

| | | |
|---|---|---|
| 201659 | 8/1983 | Fed. Rep. of Germany . |
| 2081602 | 10/1971 | France . |
| 2371294 | 6/1978 | France . |
| 2086854 | 5/1982 | United Kingdom . |
| 2154200 | 9/1985 | United Kingdom . |

*Primary Examiner*—Gary E. Elkins

*Attorney, Agent, or Firm*—Marmorek, Guttman & Rubenstein

[57] ABSTRACT

The invention relates to a package for liquid made of a coated cardboard composite, having a pierceable opening for a drinking straw, which has incisions 11 running towards one another in the form of rays or a star, and perferably a cutout 9 located at the star point of the incisions. An opening thus constructed for a drinking straw easily enables an arbitrarily concentric expansion of the star flaps located between the incisions, so that said flags rest sealingly on the drinking straw in each case. This guarantees for different drinking straws a uniform opening for the drinking straw which can be introduced into the multilayer cardboard composite both before it is coated and after it is coated.

15 Claims, 3 Drawing Sheets

PACKAGE FOR LIQUID

Figure 1:
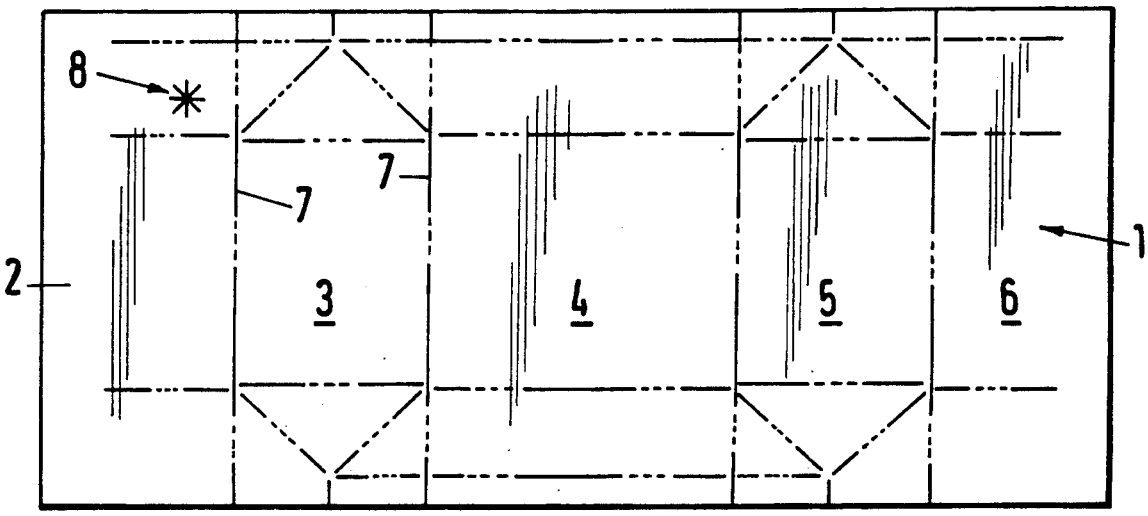

The invention relates to a package for liquid made of a coated cardboard composite, having a pierceable opening for a drinking straw.

It is known from practice to construct openings for drinking straws for packages for liquids in the form of a punched hole or punched flap. The size of these punchings must be matched to the particular diameter and cross-section of the drinking straw provided for use. This means that different openings are required for drinking straws of different diameter. However, because of the multiplicity of varieties of drinking straws available on the market, this required coordination in diameter is scarcely to be realized.

Various processes are known for introducing the punched hole or flap. Thus, the punched holes or flaps are introduced in the extruder before the coating of the multilayer cardboard composite, and the latter is subsequently coated, e.g. with a polyethylene layer (DD 201 659). This type of introduction of punchings into the multilayer cardboard composite results in the fact that the item must already be coated bound to order in the extruder.

A further possibility of undertaking the punchings in the multilayer cardboard composite consists in undertaking the punchings after coating in the extruder by means of half-cut or double-cut openings (DE No. 7,037,657 A1). Half-cut openings are understood to be punchings which are such that—being introduced from the outside go only partly through the cardboard composite, while in the case of double-cut openings incisions with diameters of different size are introduced from opposite sides of the cardboard composite. In the case both of the half-cut and of the double-cut punchings, the binding to order does not begin until in the punching or printing machines. In the case of punchings introduced in this way, that is to say undertaken at the final outfitting, it is not possible to obtain a thoroughgoing seal between the drinking straw and the punching, unless the drinking straw and the punching are coordinated with one another in diameter. If no precise coordination is done, during manipulation an unintended escape of the contents from the piercing site next to the drinking straw can be controlled only with difficulty.

Consequently, consumers have come to accept substantially coated punchings for the openings for drinking straws, which are to be opened using a pointed drinking straw, and in the case of which the drinking straw is tightly surrounded by the pierced foil or coating. On the one hand, this prevents an unintended slipping of the drinking straw into the package for the liquid and, on the other hand, no liquid can run out from the piercing site next to the drinking straw. However, in the case of this type of opening for a drinking straw, the so-called wash bottle effects must be accepted. Again, this type of opening for a drinking straw has proved to be problematical to the extent that in the case of ever larger diameters, something which is necessary for viscous drinks and drinks containing the flesh of fruit, there is an increase in the danger of so-called pin-hole formation during extrusion.

It is the object of the invention to create a package for liquid of the type mentioned at the beginning, with which it is possible to achieve in a simple fashion an optimum matching of the opening for the drinking straw to drinking straws of different diameter and cross-section, uncontrolled escape of the contents from the piercing site next to the drinking straw thus being avoided.

This object is achieved according to the invention in that the opening for the drinking straw is formed by incisions running towards one another in the form of rays. The means according to the invention bring about an opening for a drinking straw which can be opened by the drinking straw to different extents, so that said opening matches the diameter of drinking straws of different sizes. This means that when the drinking straw is introduced the opening for the drinking straw can expand arbitrarily concentrically via the flaps located between the incisions in accordance with the diameter of the drinking straw, and that in so doing said opening rests sealingly on the drinking straw in each case. It follows from this that a uniform, comparatively small opening diameter is sufficient for the most varied sizes of drinking straws. Moreover, in this way there is an avoidance of the danger of pin-hole formation, which otherwise exists during extrusion, especially in the case of comparatively large punchings. Finally, the opening for a drinking straw according to the invention can be introduced both into the uncoated cardboard—e.g. extruder—and into the ready-coated multilayer cardboard composite in the form of a half cut or double cut.

Although it is known per se (DE No. 2,751,351 C3) to provide incisions running towards one another in the form of rays in a coated cardboard composite material for a package for liquid, during the production of the package for liquid these incisions serve only to form a pour-out opening with reinforced edge and to form a pour-out spout. To be precise, during the production of the opening the incisions running towards one another in the form of rays are torn open by means of a punch, and the tabs thereby produced are folded up and folded over outwards onto the cardboard material by means of a folding tool. The tabs thus folded over are also held in their position on the finished package by means of a covering strip. After removal of the tear-open tab, they straighten out automatically and thereby form a pour-out spout. This prior art does not address the problem set by the invention of creating in a package for liquid an opening for a drinking straw which matches itself to different diameters of drinking straws.

In an expedient embodiment of the invention, the incisions are arranged in the form of a star with respect to one another. The consequence of this is necessarily that the flaps constructed in the form of a star between the incisions are matched in a more optimum fashion to the diameter of the drinking straw. For the purpose of easy piercing of the opening for the drinking straw, it has proved to be especially advantageous if the central star point of the incisions is cut out in the form of a circle. The circular cutout should have a diameter which is less than half the diameter of the circumcircle of the star-shaped incisions. Such a combined hole/star cut is introduced in the extruder before coating of the multilayer cardboard composite. It is, of course, also possible for such hole/star cuts to be introduced in the same way using the half-cut process, that is to say into the ready-coated composite. Here, too, the opening of the opening for a drinking straw is substantially facilitated if the star point is cut out correspondingly in the form of a circle.

The size of the drinking straw applied for the piercing, and of the central cutout and of the incisions is, of course, to be roughly coordinated mutually. It has proved to be particularly favorable if in the case of a diameter of the drinking straw of between 3 and 8 mm the cutout in the star point has a diameter of 1 to 3 mm, preferably 2 mm, and the star cut has four to twelve incisions, preferably eight incisions.

As already mentioned, in this regard the incisions and/or the cutout can be formed by a half or double cut, which is preferably coated. On the other hand, however, it is also possible for at least the cutout to be formed by a coated full cut.

In the case of a package for liquid, the introduction of an opening for a drinking straw into the multilayer cardboard composite can be done expediently from the point of view of process in such a way that the ray-shaped or star-shaped incisions are firstly introduced into the multilayer cardboard composite, and the latter is subsequently coated. On the other hand, there is also the possibility for the ray-shaped or star-shaped incisions to be introduced in the multilayer cardboard composite after the latter has been coated. At least for the central, circular cutout, it has proved to be advantageous if said cutout is introduced as a full cut into the multilayer cardboard composite, and the latter is subsequently coated on both sides.

Preferred illustrative embodiments of the invention are represented in the drawings, and will now be explained in more detail below.

Figure 2:
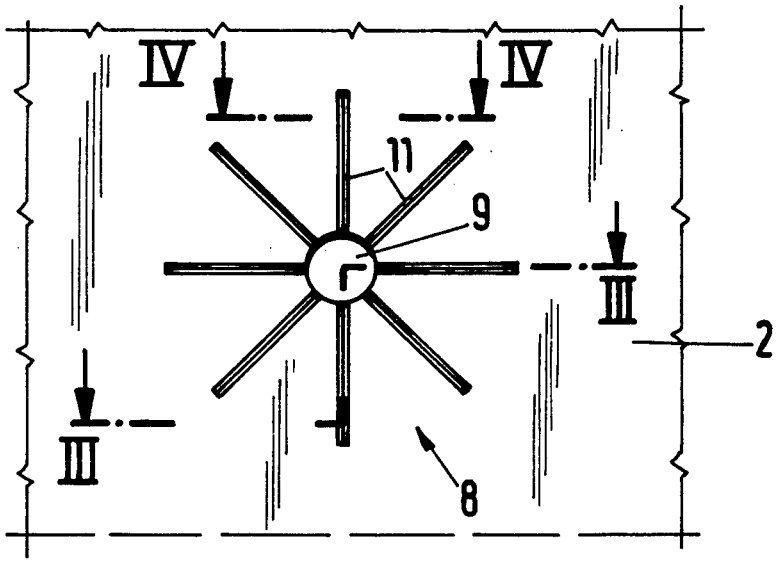
Figure 3:
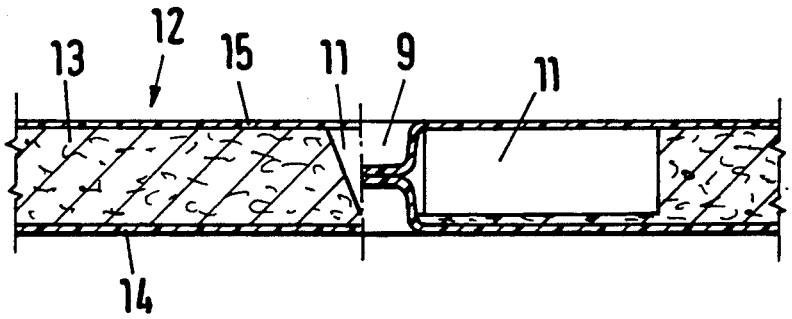
Figure 4:
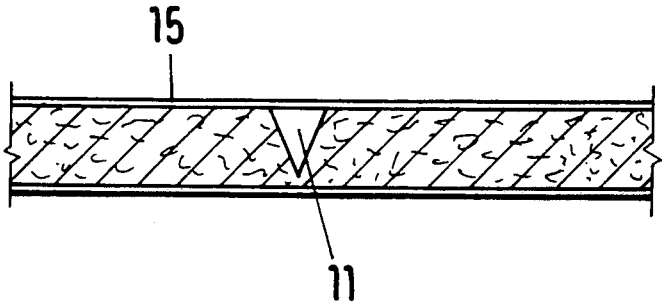
Figure 5:
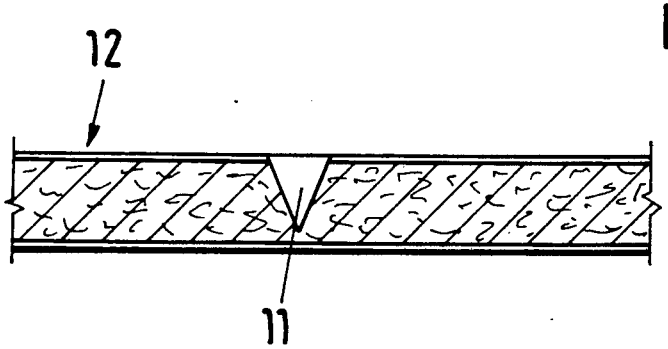
Figure 6:
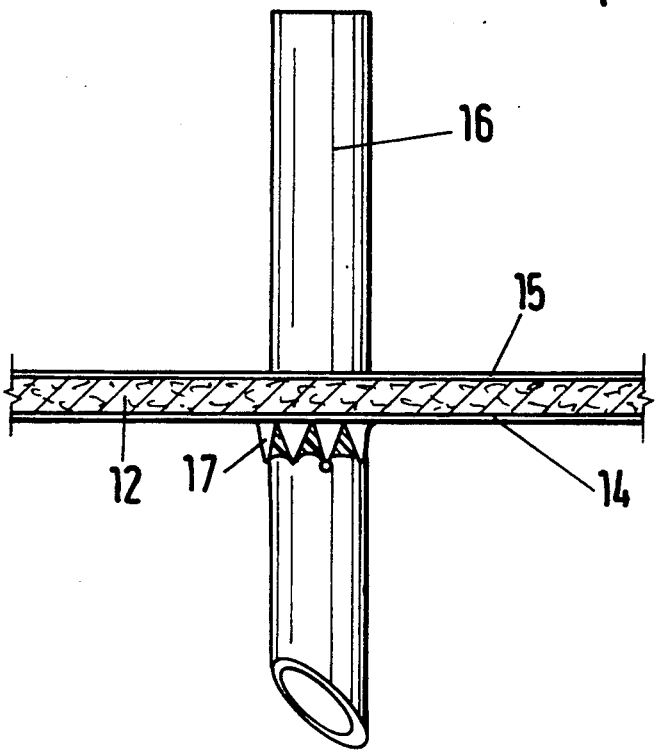
Figure 7:
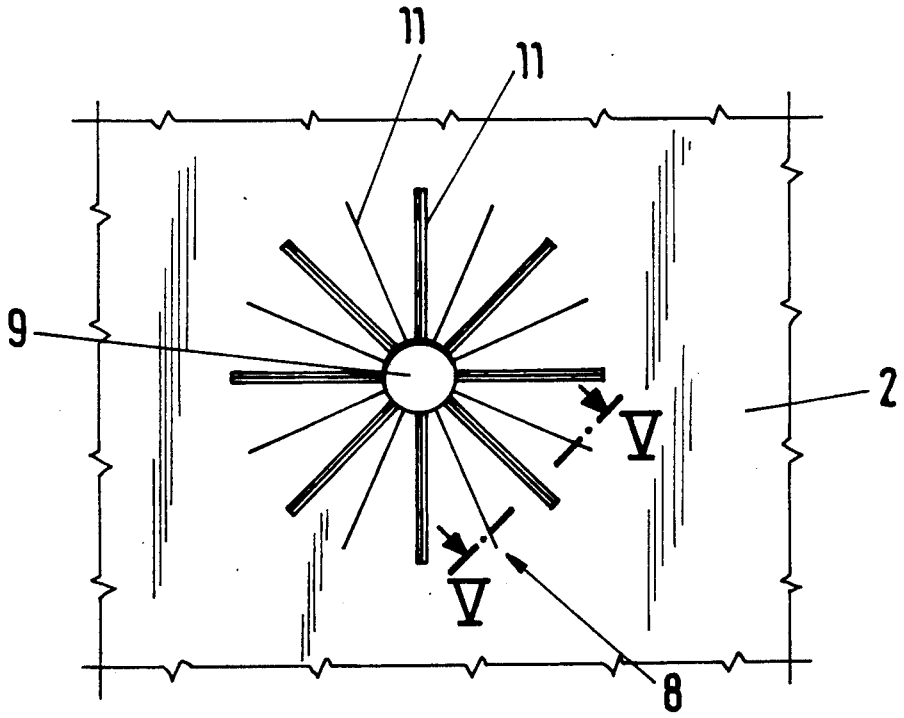
Figure 8:
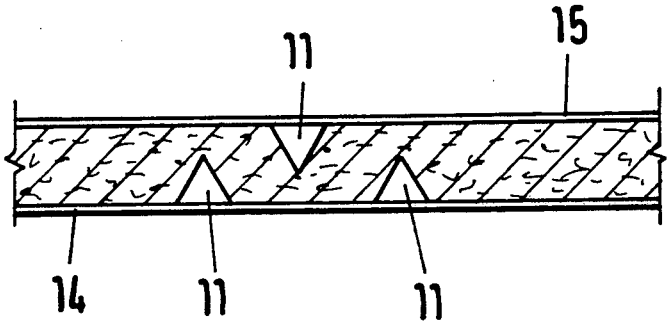

FIG. 1 shows a blank provided for producing a package for liquid, having an opening for a drinking straw according to the invention, FIG. 2 shows a detail, having the opening for a drinking straw, of the blank, on an enlarged scale, FIG. 3 shows a section along the line III—III of FIG. 2, FIG. 4 shows a section along the line IV—IV, FIG. 5 shows a cross-section, corresponding to FIG. 4, through the multilayer cardboard composite with an opening for a drinking straw with an uncoated half cut, FIG. 6 shows a cross-section through the package for liquid with an inserted drinking straw inside the opening for the drinking straw, on an enlarged scale, FIG. 7 shows a detail corresponding to FIG. 2, but embodied via, a double cut, FIG. 8 shows a section along the line V—V of FIG. 7.

Represented in FIG. 1 for the purpose of producing a package for liquid is a blank 1 with a plurality of side-wall parts 2, 3, 4, 5, 6, the individual side-wall parts of blank 1 being separated from one another by fold lines 7. Located in the upper region of the side-wall part is an opening for a drinking straw 8 in the form of a star cut, which is represented in FIG. 2 on an enlarged scale. As may be seen therefrom, the starcut-shaped opening for a drinking straw 8 possesses a concentric cutout 9 and incisions 11 starting therefrom and extending in the form of a star. The cutout 9 in the star point of the incisions 11 extending in the form of a star with respect to one another, and the incisions 11 themselves can be arranged in the most varied ways in the multilayer cardboard composite 12.

As follows from FIG. 3, the multilayer cardboard composite consists of a cardboard layer 13 and a coating 14, 15 for example made of polyethylene arranged on the inside and outside of said cardboard layer. Further layers, such as, e.g., an aluminum layer, can be provided in a fashion not represented. The incision 11 is constructed in the left-hand part of FIG. 3 as a half cut. This half cut is introduced in the extruder before the coating of the multilayer cardboard composite 12. The corresponding incision 11 is arranged and constructed analogously on the right-hand side of FIG. 3. As follows from the right-hand part of FIG. 3, the central cutout 9 is constructed as a full cut, and subsequently coated on both sides.

In the case of the variant embodiment according to FIG. 4, the full cross-section of an incision 11 is represented, which is introduced as a half cut into the uncoated cardboard, and subsequently covered by means of a coating 15. By contrast, FIG. 5 represents an incision 11 as a half cut, which is not introduced into the multilayer cardboard composite 12 until after the coating by means of a rotating cylinder or similar device.

As follows from FIG. 6, the inner coating 14 is pierced upon introduction of a drinking straw 16 into the opening for a drinking straw. In this process, the star flaps 17 located between the incisions are expanded concentrically correspondingly, so that said flaps rest sealingly on the drinking straw 16, because the cardboard tears in the predetermined cuts 11, whereas the flexible, stretchable coating 14 does not. In other words, this means that the cardboard tears open principally in an essentially vertical direction, that is to say in the direction of piercing inside the predetermined incisions, while the coating is so elastic that it is only stretched, and does not tear until overstretching at arbitrary points. Furthermore, the tension produced by the stretching of the coating guarantees that the drinking straw 16 cannot slip uncontrolled into the package for liquid.

In the case of piercing of the double-cut version according to FIGS. 7 and 8, the star flaps cover one another like scales, so that the sealing effect between drinking straw and opening is further intensified.

In the case of this version, apart from the tearing open in the incisions in a vertical direction there is, in addition, a splicing between the incisions in an essentially horizontal direction.

Experiments carried out have shown that best results for drinking straws of between 3 and 8 mm diameter have been achieved when the cutout in the star point is maintained at from 1 to 3 mm, preferably 2 mm, and the number of the incisions extending in the form of rays or a star is chosen at between four to twelve, preferably eight incisions.

It has also been established within the framework of the invention that in the case of drinking straws of 3 mm diameter, good results can be achieved even in the case of a four-ray cross cut. With increasing diameter of the drinking straw, better results can be achieved in the case of, for example, eight rays.

It goes without saying that the invention is not limited to the illustrative embodiments represented, but also allows modifications within the framework of the claims. Thus, in addition to the cutout in the form of a hole, it would also be possible in principle for each section to be constructed as a full cut. Moreover, the drinking straw used for the piercing need not be circular in cross-section; rather, it can also be constructed oval or polygonal in cross-section.

We claim:

1. A package for holding a liquid, comprising:

a container made from cardboard walls having a coating thereon, said cardboard walls having inside and outside wall surfaces, a pierceable opening in said container for receiving a drinking straw, and a plurality of incisions in said container extending radially from said opening in the form of rays.

2. The package of claim 1 wherein said incisions extend radially from said opening in the form of a star.

3. The package of claim 1 wherein said opening comprises a circular cutout, said incisions extending radially from said cutout.

4. The package of claim 3 wherein the diameter of said circular cutout is less than half the diameter of a circumcircle of said radially extending incisions.

5. The package of claim 4 wherein the diameter of said circular cutout is less than one-quarter of the diameter of a circumcircle of said radially extending incisions.

6. The package of claim 3 wherein said circular cutout has a diameter which is equal to or less than the diameter of a drinking straw to be received.

7. The package of claim 6 wherein said circular cutout has a diameter of about 1 to 3 mm for receiving a drinking straw having a diameter of about 3 to 8 mm.

8. The package of claim 7 wherein said circular cutout has a diameter of about 2 mm.

9. The package of claim 1 comprising about 4 to 12 incisions.

10. The package of claim 9 comprising 8 incisions.

11. The package of claim 1 wherein said incisions comprise half-cuts through a wall surface of said cardboard walls.

12. The package of claim 3 wherein said circular cutout comprises a half-cut through a wall surface of said cardboard walls.

13. The package of claim 11 wherein said half-cuts are mutually offset half-cuts through said inner and outer wall surfaces of said cardboard walls.

14. The package of claim 13 wherein said half-cuts are covered with said coating.

15. The package of claim 3 wherein at least said circular cutout comprises a fullcut through a wall surface of said cardboard walls, said fullcut being coated on mutually opposite sides.

* * * * *